US005702042A

United States Patent [19]

Peacock

[11] Patent Number: 5,702,042

[45] Date of Patent: Dec. 30, 1997

[54] HARNESS CARRIER

[75] Inventor: Ivan P. Peacock, Essex, England

[73] Assignee: Renegade Action Sports, Inc., Indiana, Pa.

[21] Appl. No.: 545,426

[22] Filed: Oct. 17, 1995

[51] Int. Cl.[6] ..... A45F 3/00

[52] U.S. Cl. ..... 224/662; 224/637; 224/660; 2/44

[58] Field of Search ..... 224/644, 637, 224/215, 660, 662, 663, 676, 682, 664; 2/44, 311, 312; D3/226, 230; 602/19

[56] References Cited

U.S. PATENT DOCUMENTS

| | | | |
|---|---|---|---|
| 2,386,708 | 10/1945 | Morrison | 2/312 |
| 2,995,282 | 8/1961 | Wells et al. | 224/662 |
| 4,139,130 | 2/1979 | Glusker et al. | 224/676 |
| 4,390,014 | 6/1983 | Forman | 602/19 |
| 5,122,111 | 6/1992 | Sebastian et al. | 602/19 |
| 5,188,586 | 2/1993 | Castel et al. | 602/19 |
| 5,205,448 | 4/1993 | Kester et al. | 224/240 |
| 5,240,156 | 8/1993 | Sicotte et al. | 224/240 |
| 5,274,851 | 1/1994 | Simpkins, Sr. et al. | 2/44 |
| 5,349,706 | 9/1994 | Keer | 2/44 |
| 5,387,183 | 2/1995 | Jones | 602/19 |
| 5,399,151 | 3/1995 | Smith | 2/44 |
| 5,551,085 | 9/1996 | Leighton | 2/44 |

FOREIGN PATENT DOCUMENTS

| | | | |
|---|---|---|---|
| 2367446 | 6/1978 | France | 224/215 |
| 2464673 | 4/1981 | France | 224/215 |
| 1197192 | 7/1965 | Germany | 602/19 |

OTHER PUBLICATIONS

Journal of The Americam Medical Association; vol. 168, No. 7, p. 930, Oct. 1958.

*Primary Examiner*—Henry J. Recla
*Assistant Examiner*—Gregory M. Vidovich
*Attorney, Agent, or Firm*—Titus & McConomy

[57] ABSTRACT

A harness carrier having a back support member with a configuration adaptable to the back of a user which includes terminating ends. Attached to the support member is a first pair of straps which are adapted to attach to each other and secure the harness to the user. An elastomeric member is attached to the support members to define a cord spanning from about 50 to 90 percent of said support member.

5 Claims, 2 Drawing Sheets

HARNESS CARRIER

FIELD OF THE INVENTION

The present invention relates to a harness carrier and, in particular, to a harness support means for back carriers used to carry items used in certain competitive events.

BACKGROUND OF THE INVENTION

Back carriers such as back packs, knapsack and the like are very well known. Generally these devices include a container or support frame for carrying or attaching a load and a fastening means to the body. The fastening means can be shoulder straps or strapping around a persons waist. In some cases it is a combination of one or more of these support means.

In certain competitive applications such as sporting events like bicycling, paintball and the like it is preferable to utilize a back carrier without shoulder straps, a harness, because of the various postures assumed during the events.

One type of back carrier or harness utilizes a back member which generally conforms to the shape of the back and which has attached thereto one or more containers used by the sporting participant. The preformed member may be flexible or semi-rigid and includes one or more straps which fasten around the participants waist or midsection of the body. Depending upon the weight and bulk to be carried these devices have been more or less successful. However, in sporting tournaments involving paintball, the harness carriers are used for carrying bottles or canisters of gas such as nitrogen used as the propellant for the paintball gun as well as up to 1500 paintballs. As these guns have become more powerful and the tournaments or competition more lengthy, the mount of nitrogen and the number of paintballs to be carried has grown. Back carriers for gas canisters have grown in weight and size also.

The result of the increased size and weight is an increased instability in the positioning of the harness on the back as the participant adjusts to various positions such as running, prone or crawling positions. In such cases the harness carrier tends to twist or torque about the body and becomes an obstruction to the participant. Tightening the straps has not provided a satisfactory solution because such action has the effect of making it very uncomfortable or constricting for the participant. Relocation of the straps has not provided a solution either although it has offered additional stability when running.

Accordingly, it is an object of the present invention to provide an improved back carrier which is particularly useful in sporting events where various body positions are assumed. It is also an object of the invention to provide a harness having improved stability and support for weighty or bulky containers or loads. It is yet a further object of the invention to provide a harness that is comfortable and secure to wear in competition while carrying heavy loads.

SUMMARY OF THE INVENTION

Generally, the present invention provides a back harness comprising a back support member made preferably of a flexible or semi-rigid material such as polyethylene or laminated board adaptable to an arcuate configuration. Preferably, the material is a decorative fabric with a coating of flexible polyvinyl chloride applied to the back to provide a slight degree of rigidity. Also useful are materials such as leather or cordoba. Preferably, the configuration is adapted to conform to the arch of the back or preformed as a slight arc. Optionally positioned over a preformed back support member is a fabric such as a camouflage material when used in paintball competition or other material such as nylon to provide a decorative covering. Attached to the outside of the back support member is a container means or means for securing one or more containers. In the case where an outer covering is used over the back support member, the containers can be sewn or attached to the material or otherwise attached to the support member by adhesive or other fastening means. One or more straps are attached to the support member for securing the support to the user. Preferably, the straps include Velcro® fastening means (hook and loop fasteners) so that the straps can be placed together in rapid fashion. Standard buckles or clasps can be used to secure the straps to one another.

Spanning the concave or body side of the back support member is an elastic band. The elastic band is preferably from six to eight inches in width and has a length that forms a cord within 60% to 80% of the included arc. Preferably, the elastic band comprises a conventional elastic material which resists deformation. The elastic band suspends the back support member from the back of the wearer even with normal loads in the prone or crawling position. The elastic material is preferably not so resistive to deformation that it will not expand against the back support member when heavy loads are secured to the back support member when worn in the horizontal position.

Surprisingly, it has been found that the addition of the elastic band stabilizes the back harness during competition while the wearer is carrying heavy loads such as nitrogen tanks in paintball competition. In addition to the stability, the back carrier is comfortable to wear even with heavy loads. Other advantages of the present invention will become apparent from a perusal of the following detailed description of a presently preferred embodiment of the invention taken in connection with the accompanying drawings.

PRESENTLY PREFERRED EMBODIMENT

Figure 1:
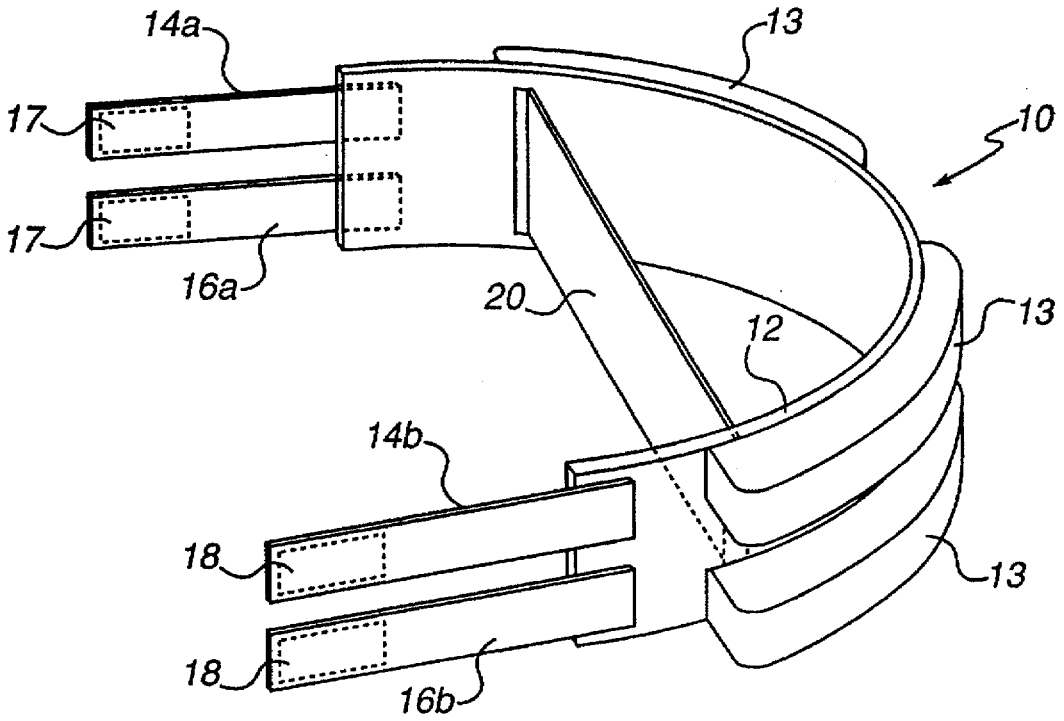
FIG. 1 is a perspective view of the back carrier of the present invention.
Figure 2:
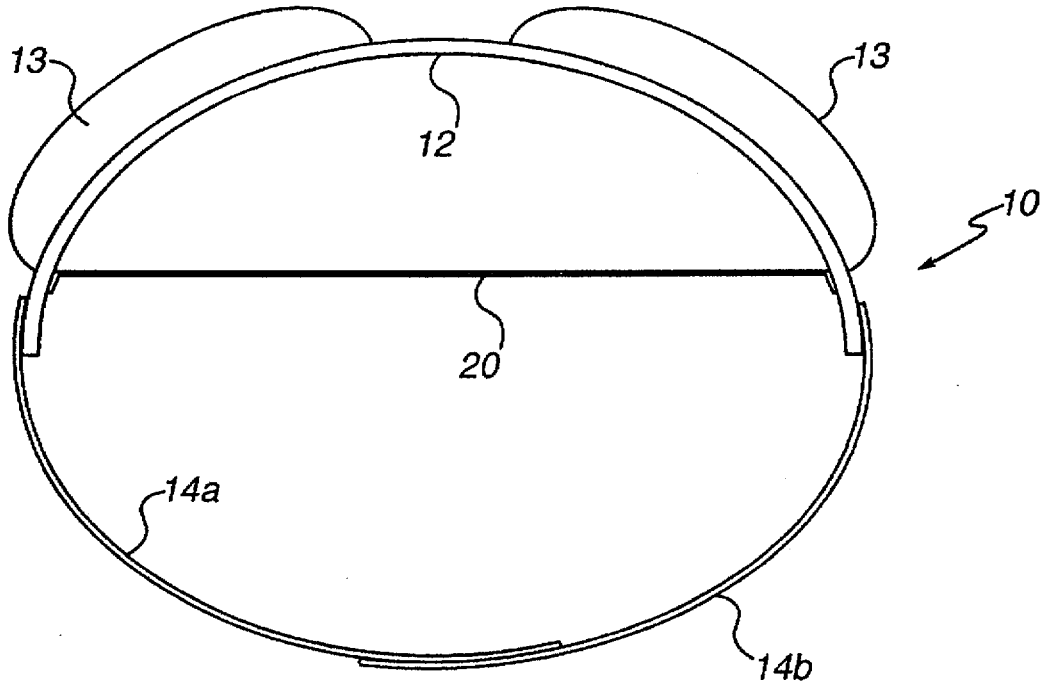
FIG. 2 is a plan view of the back carrier shown in FIG. 1.
Figure 3:
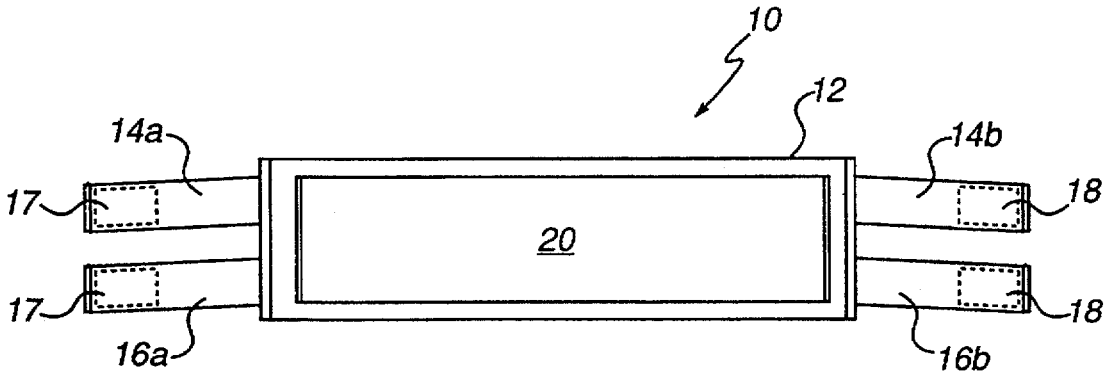
FIG. 3 is front elevation of the carrier shown in FIG. 1.

Referring to FIG. 1, harness carrier 10 comprises a back support member 12 which is preferably arcuate in configuration. The support member 12 is made from a sheet of polyethylene that is vacuum molded and covered with a decorative fabric. Preferably, support member 12 is made from a decorative fabric which has a polyvinyl chloride applied to the back to form a flexible laminate. In the case of harnesses for use in paintball competition, a polyvinyl chloride flexible laminate is preferred in which the fabric is typically a camouflage decor.

Attached to back member 12 is one or more containers 13 or attachment means for containers; containers 13 are preferably formed from a fabric used to cover the back member 12; that is, a camouflage material. At least one pair of straps **14*a* and 14*b* is used to hold harness 10 to a wearer's body. In a presently preferred embodiment, a second pair of straps 16*a* and 16*b* are used to provide a stable and secure attachment during strenuous competition. Straps 14 and 16 preferably include Velcro® attachments 17 and 18**, but conventional buckling means may be used.

An elastic member 20 is positioned across the back of support member 12. Preferably, an elastic member is positioned near the ends of member 12 defining a cord which includes from about 50 to 90 percent of the member 12, preferably, the elastic member is made from a rubberized fabric and spans preferably about 60 to 80 percent of the back of support member 12. The elastic member 20 is formed from an elastic fabric material which deforms to the contours of back member only under heavy loads when a user is in the crawling position. It has been found that the use of elastic member 20 substantially increases the stability and comfort of harness 10 when under load in competition.

While a presently preferred embodiment of the invention has been shown and described in particularity, the invention may be otherwise embodied within the scope of the appended claims.

What is claimed is:

1. A harness carrier for carrying items on a back of a wearer, said carrier comprising:

a. a back support member having a substantially arcuate configuration when in a substantially relaxed state, said support member including terminating, opposing ends and being configurable to the shape of the back of a wearer;

b) at least one carrier means mounted to said back support member for carrying game accessories;

c) at least a pair of straps, each of said straps being respectively attached to said support member at said terminating ends of said support member and being adapted to attach to each other for supporting said carrier means from the waist of a user when in use; and d) an elastomeric member resistive to deformation having opposite ends attached to said support member in a chordal relationship therewith such that said elastomeric member is interposed between said back support member and the back of a wearer when in use, said opposite ends of said elastomeric member spaced from said terminating ends such that said elastomeric member spans between about fifty to ninety percent of said back support member, wherein said elastomeric member suspends said back support member from the back of a wearer when normal loads are carded by said carrier means and expands against said back support member when heavy loads are carded by said carrier means.

2. A harness carrier as set forth in claim 1 including a second pair of straps attached to said support member.

3. A harness carrier as set forth in claim 1 including a second pair of straps, one each of said second pair being respectively attached to said support member at one of said terminating ends and adapted to attach to each other, and each of said straps including flexible releasable attachment means.

4. A harness carrier as set forth in claim 1 wherein said elastomeric member spans 60 to 80 percent of said support member.

5. A harness carrier as set forth in claims 1 wherein said back support member is a preformed substantial arcuate element.

* * * * *

UNITED STATES PATENT AND TRADEMARK OFFICE

CERTIFICATE OF CORRECTION

PATENT NO. : 5,702,042

DATED : December 30, 1997

INVENTOR(S) : PEACOCK, Ivan P.

It is certified that error appears in the above-identified patent and that said Letters Patent is hereby corrected as shown below:

In Column 4, line 11, the word "carded" should be "carried"

In Column 4, line 13, the word "carded" should be "carried"

Signed and Sealed this

Ninth Day of June, 1998

*Attest:*

Bruce Lehman

BRUCE LEHMAN

*Attesting Officer*

*Commissioner of Patents and Trademarks*